US012607109B2

(12) United States Patent
Su et al.

(10) Patent No.: US 12,607,109 B2
(45) Date of Patent: Apr. 21, 2026

(54) RAPID MINING METHOD FOR SANDSTONE-TYPE URANIUM RESOURCES IN URANIUM AND COAL SUPERPOSED AREA

(71) Applicant: Beijing Research Institute of CH.E. and Metall., Beijing (CN)

(72) Inventors: Xuebin Su, Beijing (CN); Weimin Que, Beijing (CN); Meifang Chen, Beijing (CN); Yufeng Cui, Beijing (CN); Yihan Yang, Beijing (CN); Lixin Zhao, Beijing (CN); Wensheng Liao, Beijing (CN); Yongguo Xing, Beijing (CN); Chuanfei Zhang, Beijing (CN); Ying Xu, Beijing (CN); Zhiming Du, Beijing (CN); Jiandang Huo, Beijing (CN); Mingtao Jia, Beijing (CN); Zhengbang Liu, Beijing (CN); Zhaokun Li, Beijing (CN)

(73) Assignee: Beijing Research Institute of CH.E. and Metall., Beijing (CN)

( * ) Notice: Subject to any disclaimer, the term of this patent is extended or adjusted under 35 U.S.C. 154(b) by 216 days.

(21) Appl. No.: 18/526,559

(22) Filed: Dec. 1, 2023

(65) Prior Publication Data

US 2024/0191608 A1 Jun. 13, 2024

(30) Foreign Application Priority Data

Dec. 13, 2022 (CN) ..... 202211592393.0

(51) Int. Cl.
*E21B 43/28* (2006.01)
*E21B 43/14* (2006.01)

(52) U.S. Cl.
CPC ..... *E21B 43/28* (2013.01); *E21B 43/14* (2013.01)

(58) Field of Classification Search
CPC ..... E21B 43/28; E21B 43/14; E21C 41/16
See application file for complete search history.

(56) References Cited

U.S. PATENT DOCUMENTS 4,113,313 A * 9/1978 Terry ..... E21B 43/28 166/256
2021/0032970 A1* 2/2021 Li ..... E21C 41/16
(Continued)

FOREIGN PATENT DOCUMENTS

CN 106930747 * 7/2017
CN 115163025 * 10/2022
CN 115711127 * 2/2023

*Primary Examiner* — Carib A Oquendo
(74) *Attorney, Agent, or Firm* — FINNEGAN, HENDERSON, FARABOW, GARRETT & DUNNER LLP

(57) ABSTRACT

A rapid mining method for sandstone-type uranium resources in a uranium and coal superposed area, which relates to the technical field of mining engineering is provided. The method includes: arranging a high-density adjustable well pattern in an in-situ leaching mining area; determining a length and a position of a filter located on the in-situ leaching mining area through a digital well construction technology; and in a production stage, carrying out operations such as pumping/injection centralized filtration, intensified leaching, high-intensity extraction, high-intensity injection, and change of layout of the high-density adjustable well pattern to rapidly obtain sandstone-type uranium resources in a uranium and coal superposed area. A recovery speed of the sandstone-type uranium resources can be improved, and service life of the in-situ leaching mining area can be shortened.

5 Claims, 5 Drawing Sheets

(56) References Cited

U.S. PATENT DOCUMENTS

| | | | | |
|---|---|---|---|---|
| 2021/0279376 | A1* | 9/2021 | Langenborg | G06Q 50/02 |
| 2022/0290274 | A1* | 9/2022 | Wu | C22B 60/0221 |
| 2024/0026767 | A1* | 1/2024 | Su | E21B 49/00 |

* cited by examiner

RAPID MINING METHOD FOR SANDSTONE-TYPE URANIUM RESOURCES IN URANIUM AND COAL SUPERPOSED AREA

CROSS REFERENCE TO RELATED APPLICATION

This patent application claims the benefit and priority of Chinese Patent Application No. 202211592393.0 filed with the China National Intellectual Property Administration on Dec. 13, 2022, the disclosure of which is incorporated by reference herein in its entirety as part of the present application.

TECHNICAL FIELD

The present disclosure relates to the technical field of mining engineering, and particularly to a rapid mining method for sandstone-type uranium resources in a uranium and coal superposed area.

BACKGROUND

Uranium resources are important strategic resources, and more than 90% of natural uranium production comes from sandstone-type uranium deposits. Most sandstone-type uranium deposits coexist with strategic mineral resources such as coal, petroleum, natural gas in the same basin, and superposition and symbiosis of uranium and coal is the most commonly phenomenon. A development strategy of "uranium before coal" is put forward in view of the superposition and symbiosis of uranium and coal. The mining strategy of "uranium before coal" points out a scientific mining sequence for collaborative development of uranium and coal resources in this area, and further puts forward higher requirements for development efficiency and technical level of uranium resources.

The design life of an in-situ leaching uranium mining mine in China is generally 15 years to 20 years, and the design service life of a single mining area is 6 years to 8 years. The most important factors affecting a mining speed of a mining area are a uranium concentration of a leaching solution, and pumping and injection flow. Excluding objective factors and factors of a mineral deposit itself, the uranium concentration of the leaching solution is related to mining engineering means, a formula and a concentration of a leaching agent, and the pumping and injection flow is related to a lowering depth of a submersible pump, a pumping drawdown and a injection pressure. Under the actual condition of a $CO_2$+$O_2$ in-situ leaching uranium mining process, it is difficult to achieve an 80% recovery rate in the mining area within 6 years. Especially in the middle and later stages of leaching, there are many problems such as a serious blockage of deposit, decrease in the pumping and injection flow, low uranium concentration of a leaching solution, a dead corner of leaching, and the like. The service life of the mining area is required to be extended to 8 years to 10 years, or even longer.

Taking a super-large sandstone uranium deposit in the Ordos basin where uranium and coal are superimposed as an example, according to the development scale and mining method of the largest single in-situ leaching mine in China, 30 years or even longer of service life of the mining area are required. Under the condition that uranium and coal resources are not superposed in space, it is advisable to exchange time for economic exploitation of sandstone-type uranium deposits. However, under the condition that many coal mines in the Ordos basin have been put into production or completed well construction, a water level of a sandstone uranium reservoir continues to decline due to drainage of nearby coal mines, and rescue development of uranium resources in this area is imminent. Moreover, under the development strategies of uranium and coal superposition and "uranium before coal", it is necessary to speed up the development of uranium resources and provide development spaces and conditions for overlaid coal resources as soon as possible.

SUMMARY

In order to solve the above problems, the present disclosure provides a rapid mining method for sandstone-type uranium resources in a uranium and coal superposed area from the aspects of a well type, a well spacing, a pumping and injection exchange mode during production operation, high-efficiency intensified leaching, high-intensity extraction, pressurized liquid injection, balance regulation and control, etc., so as to improve a recovery speed of the sandstone-type uranium resources, and shorten the service life of the in-situ leaching mining area.

In order to realize the above objective, the present disclosure provides a technical solution as follows.

A rapid mining method for sandstone-type uranium resources in a uranium and coal superposed area, which includes:

arranging a high-density adjustable well pattern in an in-situ leaching mining area; where the in-situ leaching mining area is the uranium and coal superposed area, the high-density adjustable well pattern is in a form of a five-spot well pattern, a well diameter of a injection well located at an edge of the high-density adjustable well pattern is a first well diameter, well diameters of the injection well and a pumping well located at the non-edge of the high-density adjustable well pattern are both second well diameters, and the first well diameter is less than the second well diameters;

determining a length and a position of a filter located on the in-situ leaching mining area through a digital well construction technology; and carrying out mining operations to rapidly obtain sandstone-type uranium resources in the uranium and coal superposed area in a production stage;

where the mining operations include:

carrying out pumping/injection centralized filtration by the filter on the in-situ leaching mining area;

carrying out intensified leaching through a strong oxidation reaction and a strong complexation reaction in the production stage;

carrying out high-intensity extraction through a high-lift and large-flow submersible pump operation mode in the production stage;

carrying out high-intensity injection through a pressurized injection and uniform injection regulation and control mode in the production stage; and changing a layout of the high-density adjustable well pattern in the production stage.

Preferably, a distance between the pumping well and the injection well is 20 m to 27 m.

Preferably, the determining a length and a position of a filter located on the in-situ leaching mining area through a digital well construction technology specifically includes:

collecting well logging data of the in-situ leaching mining area in a mineral deposit exploration stage;

building a model fused with a three-dimensional heterogeneous stratum and a uranium ore body according to the well logging data;

discretizing the model fused with the three-dimensional heterogeneous stratum and the uranium ore body to form a fused model including a geometric model and a uranium grade model;

adding an in-situ leaching well drilling process on the basis of the fused model, and setting an opening position and an opening length of the filter, so as to obtain an engineering seepage model;

building engineering seepage models with different well spacings with recoverable uranium resources as an objective function, so as to obtain a preferred well spacing; and optimizing the length and the position of the filter based on determining the preferred well spacing and in order to reduce vertical dilution, so as to determine the length and the position of the filter located on the in-situ leaching mining area.

Preferably, the carrying out pumping/injection centralized filtration by the filter on the in-situ leaching mining area specifically includes:

carrying out water pumping and injection circulation on an ore-bearing aquifer by the filter before the in-situ leaching mining area is put into production; and carrying out the pumping/injection centralized filtration by the filter loaded with a reagent of "limestone and quartz sand" with a particle size of 2 mm to 5 mm after the in-situ leaching mining area is put into production.

Preferably, the carrying out intensified leaching through a strong oxidation reaction and a strong complexation reaction in the production stage specifically includes:

carrying out the intensified leaching through advanced oxidation and strong oxidation reactions in the production stage; where the advanced oxidation and strong oxidation reactions are divided into three stages, which are specifically a stage in which pre-oxidation is carried out on the ore-bearing aquifer only by means of $O_2$, a stage in which strong oxidation leaching is carried out by using "$CO_2$+$O_2$" as a leaching agent, and a stage in which strong oxidation leaching is carried out through a catalytic oxidation technology, respectively; and carrying out intensified leaching through a strong complexation reaction in the production stage; where in the strong complexation reaction, a content of $HCO_3^-$ in a uranium leaching complexing agent used is greater than 1.5 g/L.

Preferably, in the advanced oxidation and strong oxidation reactions, oxygen is added into an in-situ leaching process through a micro-nano oxygen injection technology; and in the strong complexation reaction, the content of the $HCO_3^-$ in the uranium leaching complexing agent is kept to be greater than 1.5 g/L by carrying out the pumping/injection centralized filtration through the filter or by directly adding a chemical agent into a leaching raffinate.

Preferably, the carrying out high-intensity injection through a pressurized injection and uniform injection regulation and control mode in the production stage specifically includes:

installing a wellhead device with an anti-pressure capability >2 MPa on the liquid injection well, and in the production stage, carrying out the pressurized injection by means of an in-situ leaching injection pressure of 1.0 MPa to 2.0 MPa; and controlling a injection flow of the injection well in the in-situ leaching mining area to be consistent by means of regulation and control in the production stage.

Preferably, the changing a layout of the high-density adjustable well pattern in the production stage specifically includes:

using an "I-type" five-spot high-density adjustable well pattern in an early stage and a middle stage of production in the in-situ leaching mining area; and using an "II-type" five-spot high-density adjustable well pattern in a later stage of production in the in-situ leaching mining area;

where the "I-type" five-spot high-density adjustable well pattern is composed of a plurality of squares, the injection well is arranged at four corners of the square, and the pumping well is arranged at a diagonal intersection point of the square; and the "II-type" five-spot high-density adjustable well pattern is obtained by improving the "I-type" five-spot high-density adjustable well pattern, that is, injection of the injection well located at the edge is stopped, the injection well located at the non-edge is changed into a pumping well, and the pumping well located at the non-edge is changed into a injection well.

According to the specific embodiments provided in the present disclosure, the present disclosure discloses technical effects as follows.

The present disclosure relates to a rapid mining method for sandstone-type uranium resources in a uranium and coal superposed area, which is used for a situation in which the sandstone-type uranium deposits are required to be rapidly mined under the conditions of uranium-coal superposition or other backgrounds. The present disclosure includes rapid mining measures and methods in a design stage and a production stage of the sandstone-type uranium deposit mining area. Specifically, through combined means of a high-density adjustable well pattern and digital well construction technology, pumping/injection centralized filtration, intensified leaching, high-intensity extraction, pressurized injection and uniform injection regulation and control, and well pattern regulation and control in a production stage, rapid mining purposes of a small leaching dead angle, a large leaching coverage rate, a high uranium concentration of a leaching solution, a large pumping and injection flow and a good permeability of an ore-bearing aquifer are realized. Therefore, service life of the in-situ leaching mining area can be effectively shortened, and the recovery of sandstone-type uranium resources can be accelerated.

BRIEF DESCRIPTION OF THE DRAWINGS

In order to describe technical solutions in embodiments of the present disclosure or in the prior art more clearly, accompanying drawings required to be used in the embodiments will be briefly described below. Apparently, the accompanying drawings in the following description show merely some embodiments of the present disclosure, and those of ordinary skill in the art can derive other accompanying drawings from these accompanying drawings without creative efforts.

FIG. 4A is a simulation diagram of a flow field of the well pattern using "4 injection and 1 pumping" five-spot in-situ leaching uranium mining under the condition of homogeneous sandstone reservoir on a 1st day, FIG. 4B is a simulation diagram of a flow field of the well pattern using "4 injection and 1 pump" five-spot in-situ leaching uranium mining under the condition of homogeneous sandstone reservoir on a 10th day, and FIG. 4C is a simulation diagram of a flow field of the well pattern using "4 injection and 1 pumping" five-spot in-situ leaching uranium mining under the condition of homogeneous sandstone reservoir on a 30th day; FIG. 5A is a simulation diagram of a flow field of the well pattern using "4 injection and 1 pumping" five-spot in-situ leaching uranium mining under the condition of heterogeneous sandstone reservoir on the 1st day, FIG. 5B is a simulation diagram of a flow field of the well pattern using "4 injection and 1 pumping" five-spot in-situ leaching uranium mining under the condition of heterogeneous sandstone reservoir on the 10th day, and FIG. 5C is a simulation diagram of a flow field of the well pattern using "4 injection and 1 pumping" five-spot in-situ leaching uranium mining under the condition of heterogeneous sandstone reservoir on the 30th day.

DETAILED DESCRIPTION OF THE EMBODIMENTS

Technical solutions of embodiments of the present disclosure will be clearly and completely described below in combination with accompanying drawings in the embodiments of the present disclosure. Apparently, the described embodiments are merely some embodiments rather than all embodiments of the present disclosure. All other embodiments derived by those of ordinary skill in the art on the basis of embodiments of the present disclosure without creative efforts shall all fall within the scope of protection of the present disclosure.

In order to make the above objectives, features and advantages of the present disclosure clearer and more comprehensible, the present disclosure will be further described in detail below in combination with accompanying drawings and specific embodiments.

An embodiment of the present disclosure provides a rapid mining method for sandstone-type uranium resources in a uranium and coal superposed area. According to an embodiment of the present disclosure, through combined means of a high-density adjustable well pattern and digital well construction technology, pumping/injection centralized filtration, intensified leaching, high-intensity extraction, pressurized injection, uniform liquid injection regulation and control, and well pattern regulation and control in a production period, on the basis of precise mining of a sandstone uranium ore, rapid mining is realized with a small leaching dead angle, great pumping and injection intensity and a good permeability of a deposit are realized, thus service life of a mining area is shortened, and recovery of sandstone-type uranium resources in a uranium and coal superposed area is accelerated.

Figure 1:
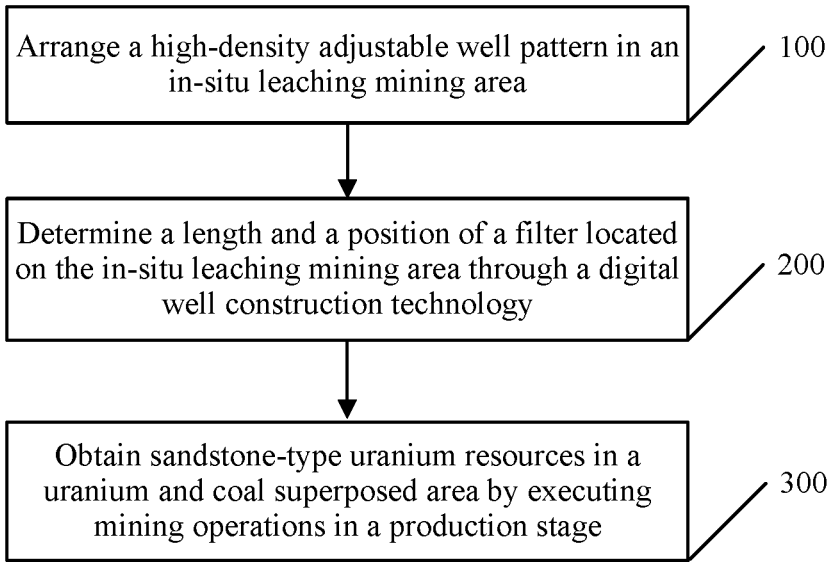
FIG. 1 is a schematic flow chart of a rapid mining method for sandstone-type uranium resources in a uranium and coal superposed area according to an embodiment of the present disclosure.
Figure 2:
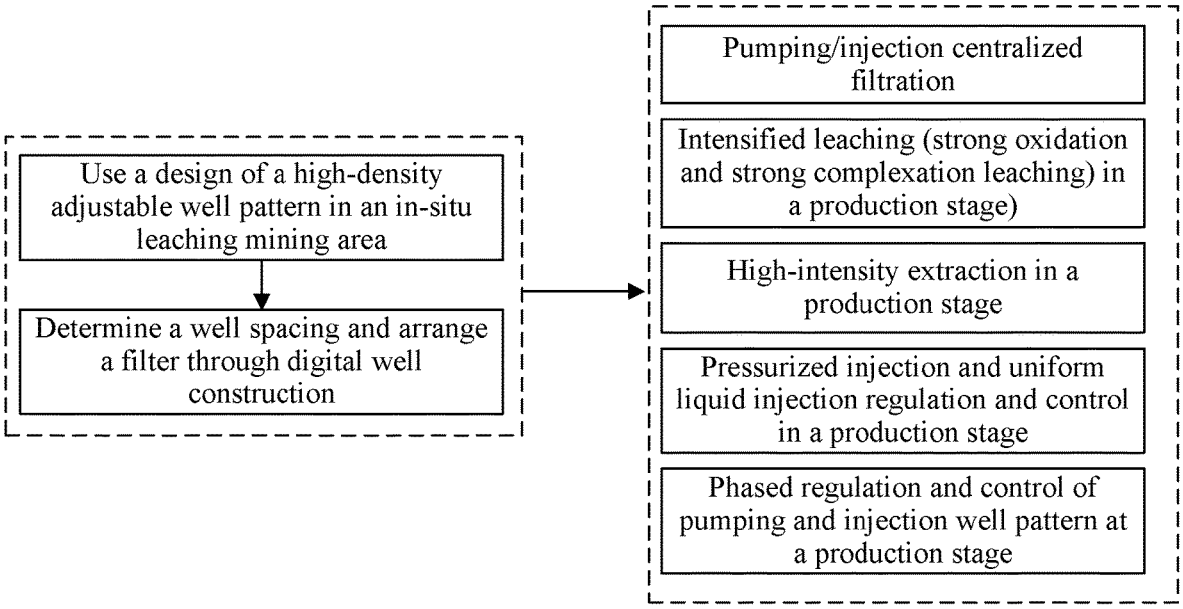
FIG. 2 is a partition flow chart of a rapid mining method for sandstone-type uranium resources in a uranium and coal superposed area according to an embodiment of the present disclosure.

The technical solution in an embodiment of the present disclosure includes rapid mining measures and methods in development, design and production stages of sandstone uranium ore in a uranium and coal superposed area, which are described as follows in combination with FIGS. 1 and 2.

In step 100, a high-density adjustable well pattern is arranged in an in-situ leaching mining area. The in-situ leaching mining area is a uranium and coal superposed area, the high-density adjustable well pattern is in a form of a five-spot well pattern, a well diameter of an injection well located at an edge of the high-density adjustable well pattern is a first well diameter, a well diameter of a injection well and a well diameter of a pumping well located at non-edge of the high-density adjustable well pattern are both second well diameters, and the first well diameter is less than the second well diameter.

Different from the existing seven-spot well pattern form and five-spot well pattern form of in-situ leaching uranium mining, in the present disclosure, a well diameter is optimized, and a five-spot well pattern form with part of the injection wells and part of the pumping wells having the same well diameter is used. Under the condition of saving well drilling cost as much as possible, the adjustment of well pattern pumping and injection functions in the middle and later stages of production in the in-situ leaching mining area is satisfied, which facilitates exchange of well types during the production process.

Figure 3:
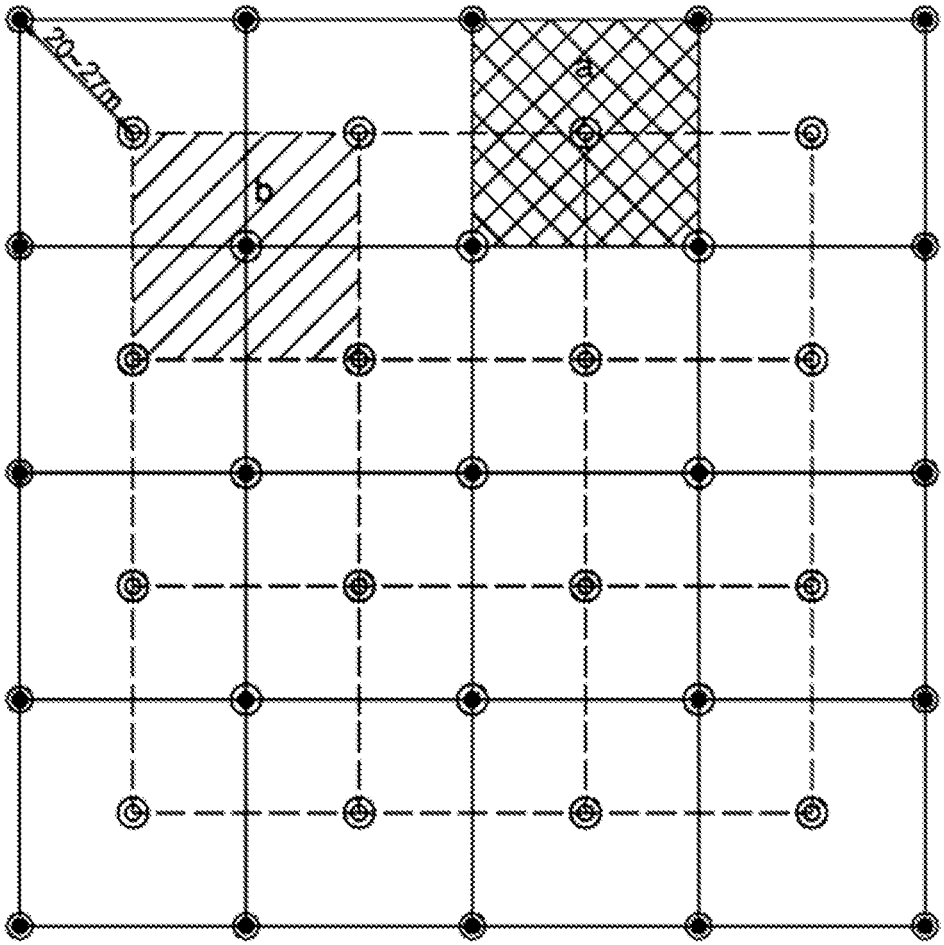
FIG. 3 is a schematic structure diagram of a high-density adjustable well pattern according to an embodiment of the present disclosure.

Specifically, the high-density adjustable well pattern provided in an embodiment of the present disclosure includes multiple squares, as shown in an area a in FIG. 3. In the high-density adjustable well pattern, the injection well is arranged at a corner of the square, and the pumping well is arranged at a diagonal intersection point of the square, so as to form a "4 injection and 1 pumping" leaching unit. Except for the injection well at the edge having a small aperture (polyvinyl chloride (PVC), φ100 mm×10 mm), all pumping wells and injection wells at the non-edge in the in-situ leaching mining area have large apertures (PVC, φ152 mm×12 mm or φ148 mm×10 mm). The well diameter of the injection well at an edge is less than an outer diameter of a 4-inch deep well submersible pump, such that the injection well at an edge can only be used as an injection well and cannot be used as a pumping well. In FIG. 3, ◎ represents an injection well, and ⊙ represents a pumping well.

In the high-density adjustable well pattern, a distance between the pumping well and the injection well, that is, a distance between the pumping hole and injection hole, is 20 m to 27 m, which is different from a distance between the pumping hole and the injection hole of 27 m to 40 m used in a conventional in-situ leaching mining area.

In step 200, a length and a position of a filter located on the in-situ leaching mining area are determined through a digital well construction technology, which is specifically as follows.

(1) Well logging data of the in-situ leaching mining area is collected in a mineral deposit exploration stage, and is stored according to a data file format recognized by three-dimensional geological modeling software; The well logging data includes drilled well coordinates, a depth, lithologic classifications (glutenite, gravel-bearing Sandstone, coarse sandstone, medium sandstone, fine sandstone, siltstone, mudstone, etc.), uranium deposit grade and other information.

(2) By means of the three-dimensional geological modeling software (such as earth volumetric studio (EVS) and Leapfrog) suitable for fine characterization of a sandstone uranium reservoir, according to the sorted well logging data, a three-dimensional heterogeneous stratum and a uranium ore body model fused with lithology and uranium grade of an ore-bearing aquifer are built.

(3) On the basis of the three-dimensional heterogeneous stratum, a space of the ore-bearing aquifer is discretized according to a certain resolution to generate a series of unit blocks, and the uranium ore body model (a uranium grade value) is assigned to the corresponding unit block in the space to form a fused model including a geometric model and a uranium grade model.

(4) On the basis of the fused model, the fused model including the geometric model and the uranium grade model is discretized and assigned according to a certain grid size to form a geometric model, an in-situ leaching uranium mining engineering and in-situ leaching well drilling process is added, and an opening position and an opening length of a filter are set to build an engineering seepage model.

(5) With a 5-year recoverable uranium resource amount as an objective function, engineering seepage models with different well spacings are built to obtain a preferred well spacing under the conditions of specific geological and ore body feature (according to actual in-situ leaching production experience, the preferred well spacing is selected within a range of 15 m to 40 m, especially mining years and recoverable resources for well spacings of 20 m to 27 m are compared).

(6) On the basis of determining the preferred well spacing, in order to reduce vertical dilution, the length and the position of the filter is optimized, and a precise leaching channel for in-situ leaching mining of a sandstone-type uranium ore body is constructed, that is, the length and the position of the filter located in the in-situ leaching mining area is determined.

In step 300, mining operations are carried out to obtain sandstone-type uranium resources in the uranium and coal superposed area at a production stage.

The mining operations include the following steps S1 and S2.

In S1, pumping/injection centralized filtration is carried out by the filter on the in-situ leaching mining area.

Before the in-situ leaching mining area is put into production, water pumping and injection circulation is carried out on an ore-bearing aquifer by the filter to realize the pre-dredging of the ore-bearing aquifer, where circulation time is 3 days to 5 days.

After the in-situ leaching mining area is put into production, pumping/injection centralized filtration is carried out by a filter loaded with a reagent of "limestone and quartz sand" with a particle size of 2 mm to 5 mm. Specifically, a main pipe of a leaching raffinate is connected to the filter, and the leaching raffinate is filtered by the filter, added with a leaching agent, and then injected into the ore-bearing aquifer through the injection well.

The filter is a common tower tube, which is similar to a resin adsorption tower for hydrometallurgy in the in-situ leaching uranium mining. In the embodiment, the filter is a ceramic container with high pressure resistance and corrosion resistance or a ferruginous container lined with PO, which is equipped with a liquid inlet pipe, an air inlet pipe, a liquid discharge pipe, an exhaust pipe and an automatic backflushing valve, etc., so as to facilitate loading, unloading and automatic flushing of limestone and quartz sand. The tower is loaded with solid particles of "limestone and quartz sand" with a particle size of 2 mm to 5 mm, and the limestone and quartz sand particles are proportioned according to a ratio of 2:1 to 1:1.

The filter filled with limestone and quartz sand is porous medium material, which reduces a flow rate of a solution and realizes settlement of fine particles. Moreover, surfaces of the limestone and the quartz sand can absorb colloids and suspended matters, so as to purify the solution. This is a low-cost method for intercepting impurities to purify the solution, which can filter out 90% or above of fine silts and suspended colloids in a pumped/injected liquid. Obviously, centralized filtration of a pumped solution (equivalent to a leaching solution) is carried out, so as to reduce adverse effects of silts and colloids on a uranium hydrometallurgical adsorption system.

In S2, intensified leaching is carried out through a strong oxidation reaction and a strong complexation reaction at the production stage, so as to increase a chemical reaction rate.

1. Advanced oxidation and strong oxidation leaching: under the condition of a $CO_2$+$O_2$ in-situ leaching uranium mining leaching process, in a first stage (about 0.5 months to 2 months), the ore-bearing aquifer is pre-oxidized only by means of $O_2$, and an addition amount of $O_2$ is 100 mg/L to 300 mg/L. Preferably, a micro-nano oxygen injection technology is used, and for oxygen leaching in a conventional $CO_2$+$O_2$ in-situ leaching process, "millimeter-scale $O_2$ bubbles" is changed into micro-scale and nano-scale bubbles by means of a gas-liquid mixed micro-nano bubble generator, so that $O_2$ bubbles are further dispersed and reduced, thereby improving oxygen utilization efficiency and an oxidation effect of the uranium deposit. In a second stage (from an end of the first stage to an end of a 3rd year after the mining area is put into production), "$CO_2$+$O_2$" is used as a leaching agent for strong oxidation leaching. Preferably, the micro-nano oxygen injection technology is used, and an addition amount of $O_2$ is 300 mg/L to 800 mg/L. In a third stage (from an end of the 3rd year after the mining area is put into production to decommissioning of the mining area), a catalytic oxidation technology is used, $CO_2$ is used as a catalytic reaction medium, one or more of KI, $NaNO_2$ and $MnO_2$ are used as a catalyst, and $O_2$ is used as an oxidant for strong oxidation leaching. The concentration of $CO_2$ is 200 mg/L to 500 mg/L, the concentration of catalyst is 20 mg/L to 100 mg/L, the concentration of $O_2$ is 300 mg/L to 500 mg/L, and oxygen is added also through a micro-nano oxygen injection technology.
2. Strong complexation leaching: $HCO_3$ is a uranium leaching complexing agent in a $CO_2$+$O_2$ in-situ leaching uranium mining process, and the second key measure of intensified leaching is to keep a content of $HCO_3$ in the uranium leaching complexing agent greater than 1.5 g/L. For example, as the in-situ leaching mining area enters middle and later stage of leaching, a content of carbonate rock in a stratum is insufficient and a content of $HCO_3$ in groundwater drops 1.5 g/L or below, $CO_2$ is introduced into a "limestone and quartz sand" filter to filter fine particles or colloidal substances in the pumped/injected liquid, and at the same time, to supplement $HCO_3^-$ in the solution by a reaction between $CO_2$ and limestone, so as to satisfy a strong complexing condition in the leaching process. Alternatively, $NaHCO_3$ or $NH_4HCO_3$ may be directly added into the leaching raffinate, so as to rapidly increase a content of $HCO_3$ in the uranium leaching complexing agent.

In step 500: high-intensity extraction is carried out through a high-lift and large-flow submersible pump operation mode in the production stage.

A production process of in-situ leaching uranium mining belongs to group well operation, the pumping well and the injection well are arranged according to certain rules (five-spot type, seven-spot type or determinant rules, etc.), the injection of the injection well may be regarded as a constant head recharge boundary of the pumping well. A calculation formula of a water level drawdown and a water pumping flow can refer to:

$$Q = \frac{2 \times 3.14 \times S \times M \times K}{\ln\frac{R}{r} + \frac{M-1}{1}\ln\left(1 + 0.2\frac{M}{r}\right)}, \quad (1)$$

where Q denotes a water overflow rate of well, with a unit of $m^3/d$; K denotes a permeability coefficient of the aquifer, with a unit of m/d; denotes a length of the filter, with a unit of m; M denotes a thickness of the aquifer, with a unit of m; S denotes a drawdown of water level in the well, with a unit of m; r denotes a radius of the well, with a unit of m; and R denotes a influence radius of water pumping, with a unit of m.

For a certain pumping well, the permeability coefficient of the ore-bearing layer, the thickness of the ore-bearing layer, the length of the filter, the radius of the well and the influence radius of water pumping (an interval between the pumping well and the injection well) in the above formula are all determined, and the water pumping flow of the pumping well may be improved only by increasing the drawdown of water level. For a sandstone uranium ore with relatively poor permeability (permeability coefficient K≤0.5 m/d), a means of adopting a high-lift and large-flow submersible pump for operation and enlarging a dewatering funnel to increase a liquid pumping flow of the drilling well has been verified by practice. See Table 1 for details.

TABLE 1

Query table of drawdown values under different flow rates (a inner diameter of the drilling well is 0.128 m, and a hole spacing is 30 m)

| Thickness of the ore-bearing aquifer (m) | Effective water inlet length of filter section (m) | Permeability coefficient (m/d) | Drawdown in the case of a liquid pumping flow of 3 $m^3/h$ (m) | Drawdown in the case of a liquid pumping flow of 4 $m^3/h$ (m) | Drawdown in the case of a liquid pumping flow of 5 $m^3/h$ (m) | Drawdown in the case of a liquid pumping flow of 6 $m^3/h$ (m) | Drawdown in the case of a liquid pumping flow of 8 $m^3/h$ (m) |
|---|---|---|---|---|---|---|---|
| 16 | 4 | 0.6 | 18.2 | 24.3 | 30.3 | 36.4 | 48.5 |
| 16 | 4 | 0.5 | 21.8 | 29.1 | 36.4 | 43.7 | 58.2 |
| 16 | 4 | 0.4 | 27.3 | 36.4 | 45.5 | 54.6 | 72.8 |
| 16 | 4 | 0.3 | 36.4 | 48.5 | 60.6 | 72.8 | 97.0 |
| 16 | 4 | 0.2 | 54.6 | 72.8 | 91.0 | 109.1 | 145.5 |
| 16 | 4 | 0.1 | 109.1 | 145.5 | 181.9 | 218.3 | 291.0 |
| 16 | 5 | 0.6 | 15.1 | 20.1 | 25.1 | 30.2 | 40.2 |
| 16 | 5 | 0.5 | 18.1 | 24.1 | 30.2 | 36.2 | 48.2 |
| 16 | 5 | 0.4 | 22.6 | 30.2 | 37.7 | 45.2 | 60.3 |
| 16 | 5 | 0.3 | 30.2 | 40.2 | 50.3 | 60.3 | 80.4 |
| 16 | 5 | 0.2 | 45.2 | 60.3 | 75.4 | 90.5 | 120.6 |
| 16 | 5 | 0.1 | 90.5 | 120.6 | 150.8 | 180.9 | 241.2 |
| 16 | 6 | 0.6 | 13.0 | 17.3 | 21.7 | 26.0 | 34.7 |
| 16 | 6 | 0.5 | 15.6 | 20.8 | 26.0 | 31.2 | 41.6 |
| 16 | 6 | 0.4 | 19.5 | 26.0 | 32.5 | 39.0 | 52.0 |
| 16 | 6 | 0.3 | 26.0 | 34.7 | 43.3 | 52.0 | 69.3 |
| 16 | 6 | 0.2 | 39.0 | 52.0 | 65.0 | 78.0 | 104.0 |
| 16 | 6 | 0.1 | 78.0 | 104.0 | 130.0 | 156.0 | 208.0 |
| 16 | 8 | 0.6 | 10.4 | 13.9 | 17.3 | 20.8 | 27.8 |
| 16 | 8 | 0.5 | 12.5 | 16.7 | 20.8 | 25.0 | 33.3 |
| 16 | 8 | 0.4 | 15.6 | 20.8 | 26.0 | 31.2 | 41.6 |
| 16 | 8 | 0.3 | 20.8 | 27.8 | 34.7 | 41.6 | 55.5 |
| 16 | 8 | 0.2 | 31.2 | 41.6 | 52.0 | 62.4 | 83.3 |
| 16 | 8 | 0.1 | 62.4 | 83.3 | 104.1 | 124.9 | 166.5 |
| 20 | 4 | 0.6 | 18.5 | 24.7 | 30.8 | 37.0 | 49.3 |
| 20 | 4 | 0.5 | 22.2 | 29.6 | 37.0 | 44.4 | 59.2 |
| 20 | 4 | 0.4 | 27.7 | 37.0 | 46.2 | 55.5 | 74.0 |
| 20 | 4 | 0.3 | 37.0 | 49.3 | 61.6 | 74.0 | 98.6 |
| 20 | 4 | 0.2 | 55.5 | 74.0 | 92.4 | 110.9 | 147.9 |
| 20 | 4 | 0.1 | 110.9 | 147.9 | 184.9 | 221.9 | 295.8 |
| 20 | 5 | 0.6 | 15.2 | 20.2 | 25.3 | 30.3 | 40.5 |
| 20 | 5 | 0.5 | 18.2 | 24.3 | 30.3 | 36.4 | 48.5 |
| 20 | 5 | 0.4 | 22.8 | 30.3 | 37.9 | 45.5 | 60.7 |
| 20 | 5 | 0.3 | 30.3 | 40.5 | 50.6 | 60.7 | 80.9 |
| 20 | 5 | 0.2 | 45.5 | 60.7 | 75.8 | 91.0 | 121.4 |
| 20 | 5 | 0.1 | 91.0 | 121.4 | 151.7 | 182.0 | 242.7 |
| 20 | 6 | 0.6 | 13.0 | 17.3 | 21.6 | 25.9 | 34.6 |
| 20 | 6 | 0.5 | 15.5 | 20.7 | 25.9 | 31.1 | 41.5 |
| 20 | 6 | 0.4 | 19.4 | 25.9 | 32.4 | 38.9 | 51.8 |
| 20 | 6 | 0.3 | 25.9 | 34.6 | 43.2 | 51.8 | 69.1 |

TABLE 1-continued

Query table of drawdown values under different flow rates (a inner diameter of the drilling well is 0.128 m, and a hole spacing is 30 m)

| Thickness of the ore-bearing aquifer (m) | Effective water inlet length of filter section (m) | Permeability coefficient (m/d) | Drawdown in the case of a liquid pumping flow of 3 $m^3/h$ (m) | Drawdown in the case of a liquid pumping flow of 4 $m^3/h$ (m) | Drawdown in the case of a liquid pumping flow of 5 $m^3/h$ (m) | Drawdown in the case of a liquid pumping flow of 6 $m^3/h$ (m) | Drawdown in the case of a liquid pumping flow of 8 $m^3/h$ (m) |
|---|---|---|---|---|---|---|---|
| 20 | 6 | 0.2 | 38.9 | 51.8 | 64.8 | 77.7 | 103.7 |
| 20 | 6 | 0.1 | 77.7 | 103.7 | 129.6 | 155.5 | 207.3 |
| 20 | 8 | 0.6 | 10.2 | 13.6 | 17.0 | 20.4 | 27.2 |
| 20 | 8 | 0.5 | 12.2 | 16.3 | 20.4 | 24.5 | 32.6 |
| 20 | 8 | 0.4 | 15.3 | 20.4 | 25.5 | 30.6 | 40.8 |
| 20 | 8 | 0.3 | 20.4 | 27.2 | 34.0 | 40.8 | 54.4 |
| 20 | 8 | 0.2 | 30.6 | 40.8 | 51.0 | 61.1 | 81.5 |
| 20 | 8 | 0.1 | 61.1 | 81.5 | 101.9 | 122.3 | 163.1 |
| 30 | 4 | 0.6 | 19.5 | 26.0 | 32.5 | 39.0 | 52.0 |
| 30 | 4 | 0.5 | 23.4 | 31.2 | 39.0 | 46.8 | 62.4 |
| 30 | 4 | 0.4 | 29.2 | 39.0 | 48.7 | 58.5 | 78.0 |
| 30 | 4 | 0.3 | 39.0 | 52.0 | 65.0 | 78.0 | 104.0 |
| 30 | 4 | 0.2 | 58.5 | 78.0 | 97.5 | 117.0 | 155.9 |
| 30 | 4 | 0.1 | 117.0 | 155.9 | 194.9 | 233.9 | 311.9 |
| 30 | 5 | 0.6 | 15.8 | 21.1 | 26.3 | 31.6 | 42.1 |
| 30 | 5 | 0.5 | 19.0 | 25.3 | 31.6 | 37.9 | 50.5 |
| 30 | 5 | 0.4 | 23.7 | 31.6 | 39.5 | 47.4 | 63.2 |
| 30 | 5 | 0.3 | 31.6 | 42.1 | 52.7 | 63.2 | 84.2 |
| 30 | 5 | 0.2 | 47.4 | 63.2 | 79.0 | 94.8 | 126.4 |
| 30 | 5 | 0.1 | 94.8 | 126.4 | 158.0 | 189.6 | 252.7 |
| 30 | 6 | 0.6 | 13.3 | 17.8 | 22.2 | 26.7 | 35.6 |
| 30 | 6 | 0.5 | 16.0 | 21.3 | 26.7 | 32.0 | 42.7 |
| 30 | 6 | 0.4 | 20.0 | 26.7 | 33.3 | 40.0 | 53.3 |
| 30 | 6 | 0.3 | 26.7 | 35.6 | 44.4 | 53.3 | 71.1 |
| 30 | 6 | 0.2 | 40.0 | 53.3 | 66.7 | 80.0 | 106.7 |
| 30 | 6 | 0.1 | 80.0 | 106.7 | 133.3 | 160.0 | 213.3 |
| 30 | 8 | 0.6 | 10.3 | 13.7 | 17.1 | 20.5 | 27.3 |
| 30 | 8 | 0.5 | 12.3 | 16.4 | 20.5 | 24.6 | 32.8 |
| 30 | 8 | 0.4 | 15.4 | 20.5 | 25.6 | 30.8 | 41.0 |
| 30 | 8 | 0.3 | 20.5 | 27.3 | 34.2 | 41.0 | 54.7 |
| 30 | 8 | 0.2 | 30.8 | 41.0 | 51.3 | 61.5 | 82.0 |
| 30 | 8 | 0.1 | 61.5 | 82.0 | 102.5 | 123.0 | 164.0 |

S3: Carry out high-intensity liquid injection through a pressurized injection and uniform liquid injection regulation and control mode in the production stage.

1. Pressurized injection: a liquid injection pressure of the in-situ leaching uranium mining production mining area is generally 0.2 MPa to 1.0 MPa, and a liquid injection flow of a single well may be increased by increasing a liquid injection pressure. For the high-intensity extraction in the step 500, even for an ore-bearing layer having a permeability coefficient of 0.1 m/d, as long as a dynamic drawdown of water level reaches 150 m, a liquid pumping flow may still reach 4 $m^3/h$. However, for a stratum under the same condition, it is extremely difficult for a single-well liquid injection flow to reach 4 $m^3/h$. By increasing a liquid injection pressure, a hydraulic gradient between the injection well and the pumping well may be increased, so as to accelerate a seepage velocity, increase a liquid injection flow and improve mining efficiency. Therefore, in a rapid mining process, a wellhead device with an anti-pressure capability >2 MPa is used for the injection well, and a pressure higher than the conventional in-situ leaching liquid injection pressure is used for pressurized liquid injection on site, and a pressure range of pressurized injection is (1.0 MPa to 2.0 MPa).
2. Uniform liquid injection regulation and control: due to local differences of borehole quality and the ore-bearing layer, under the same liquid injection pressure, the liquid injection flow of each liquid injection hole is difficult to be equal or basically equal, while non-uniform liquid injection will greatly increase a dilution degree and prolong leaching time, such that a flow rate of the injection well of each leaching unit is adjusted to be basically the same by means of regulation and control. The specific regulation and control means are as follows: installing an electromagnetic flowmeter and a remote flow regulating valve on a branch pipe of each injection well, collecting flow information of each injection well, feeding the collected flow information back to a remote well site control platform of the in-situ leaching uranium mining mine, and adjusting the flow rate of the injection well whose single well flow rate is greater than a predetermined value of 1.0 $m^3/h$ or less than a predetermined value of 0.5 $m^3$ h by a remote flow regulating valve through data statistics and balance analysis.

In S4, a layout of the high-density adjustable well pattern is changed in the production stage, which is specifically as follows.

Under a drilling well pattern layout condition in the step 100, during the well pattern production scheduling in the production stage, in the early and middle stage of production (from production to an end of the 3rd year) in the mining area, an "I-type" five-spot type is used, as shown in a in FIG. 3, and a liquid pumping flow is controlled to be greater than 1‰ to 3‰ of the liquid injection flow. In the later stage of production (from a beginning of a 4th year to a time just before decommissioning of the mining area), an "II-type"

five-spot type is used, as shown in b in FIG. 3, the injection of all injection wells at the edge of the mining area is stopped, functions of wells not at the edge are exchanged (the pumping wells are changed into the injection wells, and the injection wells are changed into the pumping wells), and the liquid pumping flow is controlled to be greater than 3‰ to 8‰ of the liquid injection flow.

Figure 4A:
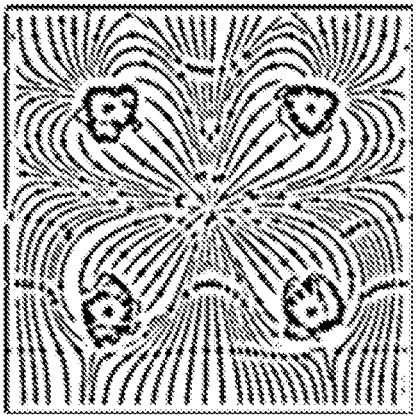
FIGS. 4A-4C are simulation diagrams of a flow field of a well pattern using a "4 injection and 1 pumping" five-spot in-situ leaching uranium mining under a condition of a homogeneous sandstone reservoir according to an embodiment of the present disclosure.
Figure 4B:
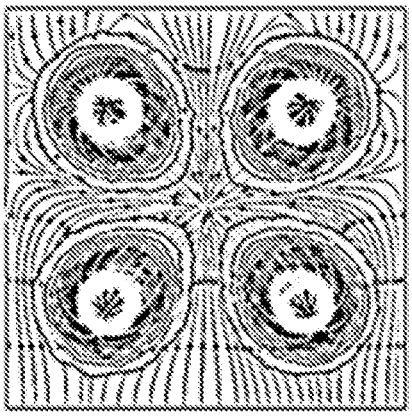
Figure 4C:
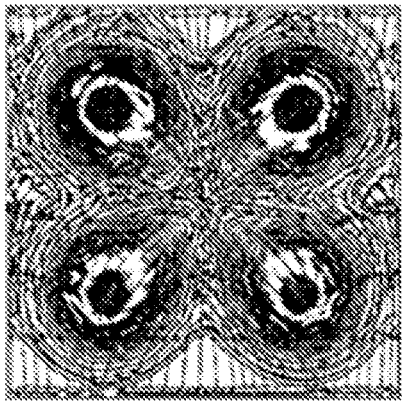
Figure 5A:
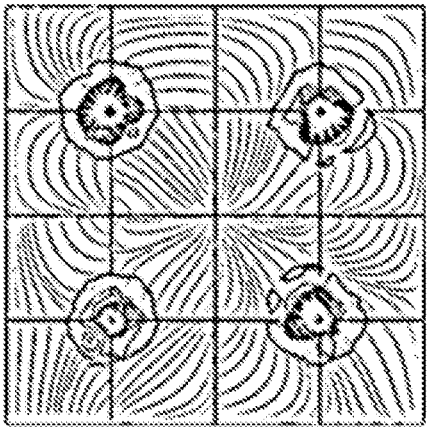
FIGS. 5A-5C are simulation diagrams of a flow field of the well pattern using "4 injection and 1 pumping" five-spot in-situ leaching uranium mining under a condition of heterogeneous sandstone reservoir according to an embodiment of the present disclosure.
Figure 5B:
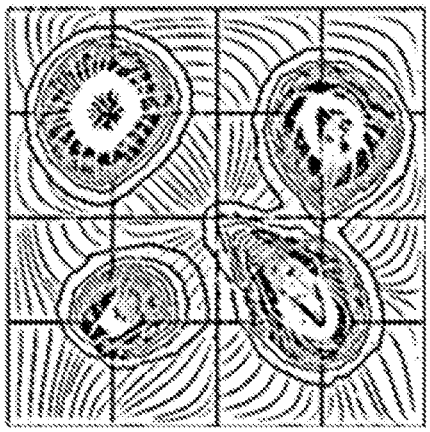
Figure 5C:
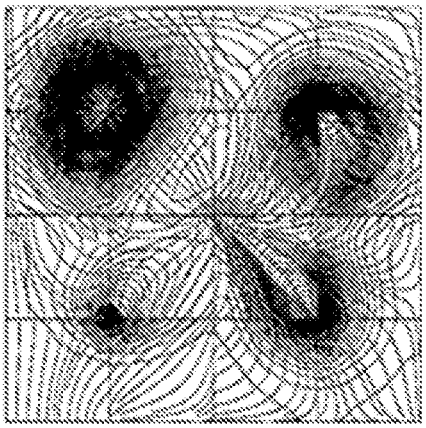

Under an ideal homogeneous stratum condition, a seepage field between the pumping well and the injection well is in a shape of a regular "spindle", as shown in FIG. 4C, a leaching dead angle is relatively small, and the ore body leaching is relatively uniform. However, the grade distribution of sandstone-type uranium reservoir and uranium ore body is heterogeneous. Due to the influence of the heterogeneous stratum, a leaching seepage field from the injection well to the pumping well becomes extremely complex, and there is a relatively large leaching dead angle in a leaching unit. An example simulation is performed in combination with stratum features of a leaching unit in an experimental mining area of Nalinggou uranium mine in Inner Mongolia, as shown in FIG. 5C. However, it can be seen from this example that the leaching is relatively sufficient within a certain range (0 m to 10 m) around the injection well, and a large number of uranium minerals may be dissolved and migrated under a long-term action of the leaching agent. Therefore, in middle and later stage of leaching in the mining area, according to the "II-type" five-spot rule, functions of the pumping well and the injection well are exchanged, that is, the pumping well are changed into the injection well and, the injection wells are changed into the pumping wells, and the uranium ore body around the original liquid pumping well and the uranium migrating from the injection well to the pumping well for a long time are dissolved and leached such that maximum leaching of the uranium ore body may be achieved.

In middle and later stage of leaching in the mining area, there are at least two advantages in exchanging the functions of the pumping well and the injection well according to the "II-type" five-spot rule.

(1) The leaching dead angle under the condition of a fixed "I-type" five-spot well pattern layout is reduced, and a recovery rate of uranium resources is improved.

(2) In middle and later stage of production in the mining area, the leaching range in the mining area is further reduced. Moreover, a ratio of pumped and injected liquids is increased, and the edge of the mining area is washed due to influx of the original stratum water, which lays a desirable foundation for the decommissioning of the mining area.

Compared with the prior art, the beneficial effects of the present disclosure are as follows.

In view of rapid development of uranium resources in uranium and coal superposed sandstone, in the design stage of sandstone uranium mining, the scientificity of well spacing determination and filter layout is improved through a high-density adjustable well pattern and digital well construction technology, and well pattern density for the purpose of rapid mining of uranium resources and a preferred filter layout scheme for the purpose of reducing vertical dilution are determined.

In the production stage of the in-situ leaching mining area, through pumping/injection centralized filtration, the blockage of the ore-bearing aquifer by fine particles and colloids is reduced, and good permeability of the ore-bearing aquifer is kept. The oxidation and complexation conditions of sandstone-type uranium resource leaching are simultaneously strengthened, and the concentration of the key leaching agent is increased to accelerate the chemical reaction process. High-intensity extraction is carried out, so as to carry out large-drawdown water pumping by a high-lift and large-flow submersible pump, and to increase the liquid pumping flow of the leaching unit, which is the most direct way to improve a mining speed. Pressurized injection is carried out, the hydraulic gradient between the injection well and the pumping well is increased, the seepage velocity of the leaching solution is increased, and moreover, uniform liquid injection regulation and control are carried out, so as to reduce dilution and a non-uniform degree of leaching in different directions of the same leaching unit as much as possible. In the early and middle stage of production in the mining area, the "I-type" five-spot type is used, and in the later stage of production, the "II-type" five-spot type is used, so as to reduce the leaching dead angle under the pumping and injection mode of the fixed well pattern, and improve the recovery rate of uranium resources.

Through an optimization design of the mining area and a series of strengthening measures in the production stage, uranium resources in the uranium and coal superposed area can be rapidly mined.

Embodiments in the specification are described in a progressive manner, each embodiment focuses on the difference from other embodiments, and the same and similar parts between the embodiments may refer to each other.

In this specification, specific examples are used to explain principles and implementations of the present disclosure. The description of the foregoing embodiments is merely intended to help understand the method in the present disclosure and its core ideas. Moreover, various modifications can be made by those of ordinary skill in the art in terms of specific implementations and the scope of application in accordance with the ideas of the present disclosure. In conclusion, the content of the specification shall not be construed as limitations to the present disclosure.

What is claimed is:

1. A rapid mining method for sandstone-type uranium resources in a uranium and coal superposed area, comprising:

arranging a high-density adjustable well pattern in an in-situ leaching mining area, wherein the in-situ leaching mining area is the uranium and coal superposed area, the high-density adjustable well pattern is in a form of a five-spot well pattern, a well diameter of an injection well located at an edge of the high-density adjustable well pattern is a first well diameter, well diameters of an injection well and a pumping well located at non-edge of the high-density adjustable well pattern are both second well diameters, and the first well diameter is less than the second well diameters;

determining a length and a position of a filter located on the in-situ leaching mining area through a digital well construction technology; and carrying out mining operations to rapidly obtain sandstone-type uranium resources in the uranium and coal superposed area in a production stage, wherein the mining operations comprise:

carrying out pumping/injection centralized filtration by the filter on the in-situ leaching mining area;

carrying out intensified leaching through a strong oxidation reaction and a strong complexation reaction in the production stage;

carrying out high-intensity extraction through a high-lift and large-flow submersible pump operation mode in the production stage;

carrying out high-intensity liquid injection through a pressurized injection and uniform liquid injection regulation and control mode in the production stage; and changing a layout of the high-density adjustable well pattern in the production stage;

wherein the determining a length and a position of a filter located on the in-situ leaching mining area through a digital well construction technology comprises:

collecting well logging data of the in-situ leaching mining area in a mineral deposit exploration stage;

building a model fused with a three-dimensional heterogeneous stratum and a uranium ore body according to the well logging data;

discretizing the model fused with the three-dimensional heterogeneous stratum and the uranium ore body to form a fused model comprising a geometric model and a uranium grade model;

adding an in-situ leaching well drilling process on the basis of the fused model, and setting an opening position and an opening length of the filter, so as to obtain an engineering seepage model;

building engineering seepage models with different well spacings with recoverable uranium resources as an objective function, so as to obtain a preferred well spacing; and optimizing the length and the position of the filter on the basis of determining the preferred well spacing and in order to reduce vertical dilution, so as to determine the length and the position of the filter located on the in-situ leaching mining area;

wherein the carrying out pumping/injection centralized filtration by the filter on the in-situ leaching mining area comprises:

carrying out water pumping and injection circulation on an ore-bearing aquifer by the filter before the in-situ leaching mining area is put into production; and carrying out the pumping/injection centralized filtration by the filter loaded with a reagent of limestone and quartz sand with a particle size of 2 mm to 5 mm after the in-situ leaching mining area is put into production;

wherein the carrying out high-intensity liquid injection through a pressurized injection and uniform liquid injection regulation and control mode in the production stage comprises:

installing a wellhead device with an anti-pressure capability >2 MPa on the injection well, and in the production stage, carrying out the pressurized injection by means of an in-situ leaching injection pressure of 1.0 MPa to 2.0 MPa; and controlling a liquid injection flow of the injection well in the in-situ leaching mining area to be consistent by means of regulation and control in the production stage.

2. The method according to claim 1, wherein a distance between the pumping well and the injection well is 20 m to 27 m.

3. The method according to claim 1, wherein the carrying out intensified leaching through a strong oxidation reaction and a strong complexation reaction in the production stage comprises:

carrying out the intensified leaching through advanced oxidation and strong oxidation reactions in the production stage, wherein the advanced oxidation and strong oxidation reactions are divided into three stages, which are a stage in which pre-oxidation is carried out on the ore-bearing aquifer only by means of $O_2$, a stage in which strong oxidation leaching is carried out by using $CO_2$+$O_2$ as a leaching agent, and a stage in which strong oxidation leaching is carried out through a catalytic oxidation technology, respectively; and carrying out intensified leaching through a strong complexation reaction in the production stage, wherein in the strong complexation reaction, a content of $HCO_3^-$ in a uranium leaching complexing agent used is greater than 1.5 g/L.

4. The method according to claim 3, wherein in the advanced oxidation and strong oxidation reactions, oxygen is added into the in-situ leaching process through a micro-nano oxygen injection technology; and in the strong complexation reaction, the content of the $HCO_3^-$ in the uranium leaching complexing agent is kept to be greater than 1.5 g/L by carrying out the pumping/injection centralized filtration through the filter or by directly adding a chemical agent into a leaching raffinate.

5. The method according to claim 1, wherein the changing a layout of the high-density adjustable well pattern in the production stage comprises:

using an I-type five-spot high-density adjustable well pattern in an early stage and a middle stage of production in the in-situ leaching mining area; and using an II-type five-spot high-density adjustable well pattern in a later stage of production in the in-situ leaching mining area;

wherein the I-type five-spot high-density adjustable well pattern is composed of a plurality of squares, the injection well is arranged at four corners of the square, and the pumping well is arranged at a diagonal intersection point of the square; and the II-type five-spot high-density adjustable well pattern is obtained by improving the I-type five-spot high-density adjustable well pattern, that is, injection of the injection well located at the edge is stopped, the injection well located at the non-edge is changed into a pumping well, and the pumping well located at the non-edge is changed into an injection well.

* * * * *